US010569935B2

(12) United States Patent
Ross

(10) Patent No.: US 10,569,935 B2
(45) **Date of Patent: *Feb. 25, 2020**

(54) DRAWSTRING TRASH BAG WITH THICK HEM REGION

(71) Applicant: Poly-America, L.P., Grand Prairie, TX (US)

(72) Inventor: Michael A. Ross, Colleyville, TX (US)

(73) Assignee: Poly-America, L.P., Grand Prairie, TX (US)

( * ) Notice: Subject to any disclaimer, the term of this patent is extended or adjusted under 35 U.S.C. 154(b) by 82 days.

This patent is subject to a terminal disclaimer.

(21) Appl. No.: 15/977,146

(22) Filed: May 11, 2018

(65) Prior Publication Data

US 2018/0257821 A1 Sep. 13, 2018

Related U.S. Application Data

(63) Continuation of application No. 14/177,389, filed on Feb. 11, 2014, now Pat. No. 9,994,365.

(51) Int. Cl.
*B65D 33/28* (2006.01)
*B65F 1/00* (2006.01)

(52) U.S. Cl.
CPC ..... *B65D 33/28* (2013.01); *B65F 1/002* (2013.01)

(58) Field of Classification Search
CPC ..... B65D 33/28; B65D 2501/24808; B65F 1/002
See application file for complete search history.

(56) References Cited

U.S. PATENT DOCUMENTS

| | | | | |
|---|---|---|---|---|
| 4,842,421 A * | 6/1989 | Bullard | B65D 33/20 383/61.4 |
| 8,591,109 B2 * | 11/2013 | Ackerman | A45C 11/20 383/104 |
| 2013/0044966 A1 * | 2/2013 | Binger | B65D 33/28 383/105 |
| 2014/0056544 A1 * | 2/2014 | Moras | B65D 33/28 383/72 |

* cited by examiner

*Primary Examiner* — Derek J Battisti
(74) *Attorney, Agent, or Firm* — Daniel J. Layden; Brandon J. Lee

(57) ABSTRACT

The present invention is directed to a thermoplastic drawstring trash bag wherein the thermoplastic drawstring trash bag has an enhanced thickness region in one or more panels of the drawstring trash bag. The enhanced thickness region has an average thickness that is greater than the thickness of the remaining portions of the panels forming the drawstring trash bag. The enhanced thickness region is generally in the area of the hems and traverses the hem seals.

14 Claims, 4 Drawing Sheets

DRAWSTRING TRASH BAG WITH THICK HEM REGION

CROSS-REFERENCE TO RELATED APPLICATIONS

Figure 1:
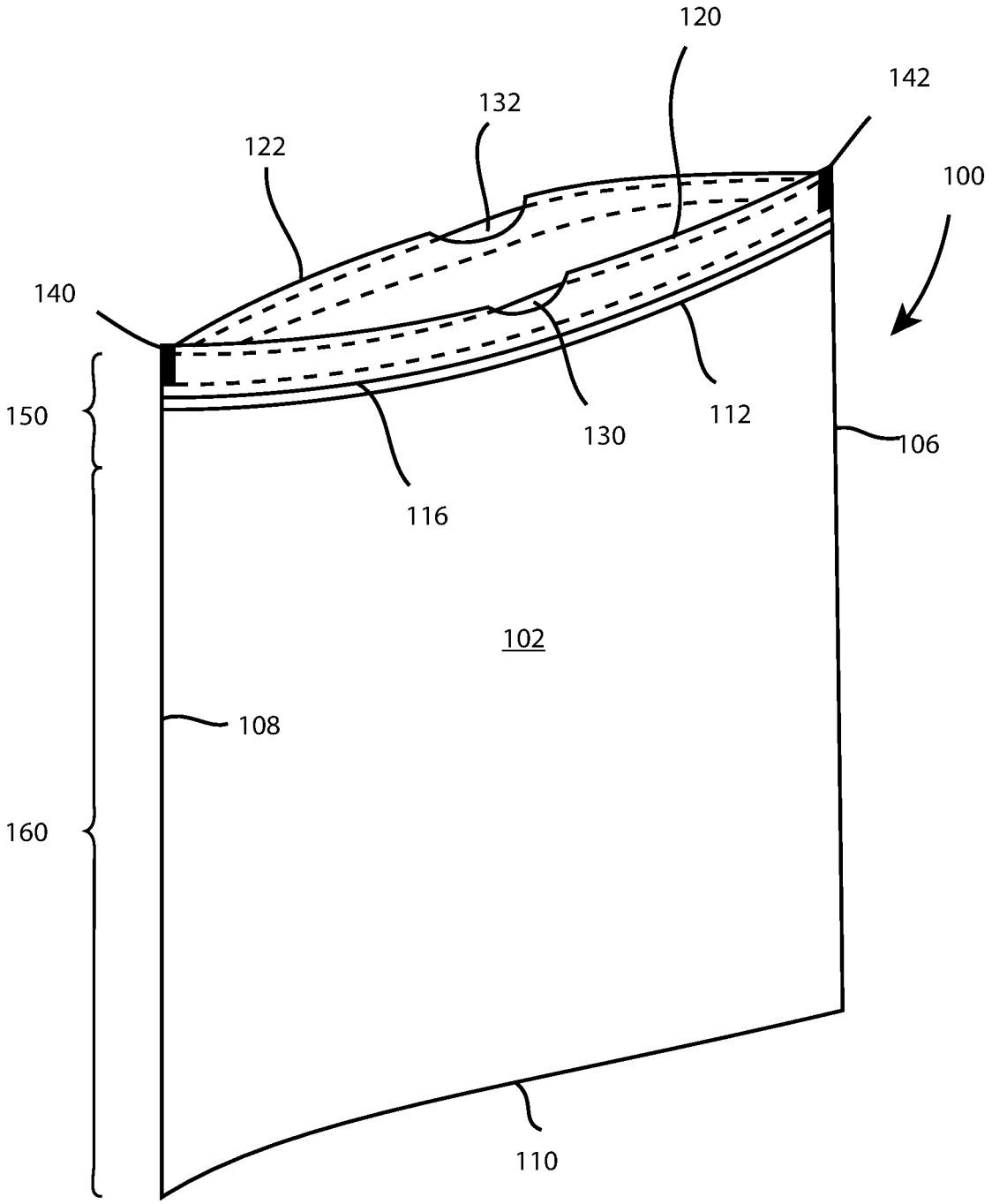

This application is a continuation of U.S. application Ser. No. 14/177,389, filed Feb. 11, 2014, and is hereby incorporated by reference into this disclosure in its entirety.

BACKGROUND OF THE INVENTION

1. Field of the Invention

The present invention relates to improvements in the construction and manufacture of polymeric bags. In particular, the present invention relates to improvements applicable to drawstring trash bags.

2. Description of the Related Art

Polymeric bags are ubiquitous in modern society, available in various capacities, thicknesses, dimensions and colors. Polymeric bags are utilized in a variety of ways including typical consumer applications such as long-term storage, food storage, and trash collection. As with many other consumer products, increased demand and new technology have resulted in innovations in the utility and performance of polymeric bags. The present invention is an innovation of particular relevance to polymeric bags used for trash collection.

Polymeric bags are manufactured from the polymeric film produced using one of several thin-film manufacturing processes known in the art, the two most common being the blown-film extrusion process and the cast-film extrusion process. Blown-film extrusion and cast-film extrusion each offer specific advantages over the other method. Consequently, the ultimate determination of the preferred manufacturing method for each specific thin-film product application is driven by considerations that may include desired film properties and advantages in cost or manufacturing speed.

For blown-film extrusion and cast-film extrusion, an extruder is used to push molten polymeric material through a die, producing a tubular film in the blown-film extrusion process or a substantially flat film in the cast-film extrusion process. Technological innovations have improved both of these manufacturing processes over the past several decades with new improvements continually being developed. Examples of such innovations include development of multi-layer dies as described in U.S. Pat. No. 4,185,954 entitled Die for Extruding Tubes Composed of Plurality of Layers and improved air cooling systems as described in U.S. Pat. No. 7,753,666 entitled Apparatus and Method for Cooling Plastic Film Tube in Blown Film Process.

One specific application of a plastic thin-film manufacturing process is in the production and conversion of plastic trash bags. Several types of trash bags are available, but drawstring trash bags are one of the popular styles of plastic trash bags, if not the most popular. Drawstring trash bags feature a hem or, more typically a pair of hems, extending along the top of the trash bag with a drawstring disposed within each hem. When using drawstring trash bags, consumers typically pull the drawstrings to close the top of the bag and subsequently tie the drawstrings together to secure the bag contents within the bag. The drawstrings also provide a convenient carry handle for transporting the filled bag.

In the prior art, it is known to provide additional strength for the drawstring. In particular, for many years drawstrings have been made with stronger and thicker materials than the body of the bag. Specifically, it has long been known in the prior art to use high-density polyethylene (HDPE) as the primary material for the drawstrings as compared to low density polyethylene (LDPE) or linear low density polyethylene (LLDPE) used for the body of the bag due to the increased stiffness and tensile strength offered by high density polyethylene. Drawstrings have also been historically thicker than the body of the drawstring trash bag to provide increased strength. For example, most drawstring trash bags are constructed with drawstrings having a thickness of 2.25 to 3 mils and a bag body thickness of between 0.7 mils and 1.2 mils. Other innovations include multilayered drawstrings for improved strength and sealing characteristics as described in U.S. Pat. No. 5,006,380. Other strategies known in the prior art include the inclusion of newer, more sophisticated materials or the use of machine direction orientation (MDO) processes. To date, however, improvements to drawstring trash bags have focused primarily on improving the performance of the drawstrings or on modifying the drawstrings in efforts to make them more compatible with the bag body. And, little to no consideration has been given improving the bag body—most specifically the hem areas—to make it more compatible with the drawstring during use. In particular, little to no attention has been paid to the area of the drawstring trash bags where the hems and hem seals are located and the area immediately surround such hem seals.

With the advent of stronger drawstrings as described above, consumers are prone to heavily load drawstring trash bags. The increased weight of the contents placed in the bags puts additional strain on the drawstring trash bag when a consumer pulls the drawstring trash bag out of a receptacle or uses the drawstrings to carry the loaded drawstring trash bag. While the stronger drawstrings developed over the years are increasingly suitable for handling such increased loads, the resultant strain can make the hem area—both the top of the hems and the hem seals—vulnerable to failure during use.

The combination of the strain from the drawstrings and the localized force from the downward pressure of the bag contents can lead to tears or even total failure of the bag in the hem areas. As a result, the top of the hem encompassing the drawstring can often break and/or the linear hem seals at the bottom of the hems may rip apart.

In light of the foregoing, a need exists for improved constructions of drawstring trash bags to enhance the performance of such bags, particularly with respect to the areas around the hems. It would be desirable to provide a drawstring trash bag that can more reliably encompass the bag drawstrings during use. The present invention provides a unique solution to these concerns and may provide other advantages not expressly described herein.

SUMMARY OF THE INVENTION

In accordance with one embodiment of the present invention, a drawstring bag comprises a first panel and a second panel. The first panel and second panel are joined along a first side edge, a second side edge, and a bottom edge. A top edge of the first panel is folded upon itself to form a first hem along an upper opening of the drawstring bag with a first hem seal defining a bottom of the first hem. The first hem seal extends from the first side edge to the second side edge of the drawstring bag.

A first drawstring is disposed and secured within the first hem. Furthermore, a first enhanced thickness region is defined in the first panel. The first enhanced thickness region extends from the first side edge to a second side edge of the drawstring trash bag and traverses the first hem seal. The average thickness of the first enhanced thickness region is greater than the average thickness of the first panel excluding the first enhanced thickness region.

In some embodiments of the present invention, the first enhanced thickness region extends from the top edge of the first panel to below the first hem seal. In another embodiment, the first enhanced thickness region extends from the top edge of the first panel to at least one inch below the first hem seal. Moreover, in another embodiment, the first enhanced thickness region extends from the top edge of the first panel to between two inches and four inches below the first hem seal. Additionally, in yet another embodiment, the first enhanced thickness region extends from the upper opening of the drawstring bag to below the first hem seal. In yet another embodiment of the present invention, the first enhanced thickness region extends from the upper opening of the drawstring bag to at least one inch below the first hem seal. Furthermore, in another embodiment of the present invention, the first enhanced thickness region extends from the upper opening of the drawstring bag to between two inches and four inches below the first hem seal.

In some embodiments of the present invention, a ratio of the average thickness of the first enhanced thickness region to the average thickness of the first panel excluding the first enhanced thickness region is between 1.1:1 and 4:1. Moreover, in some embodiments, a ratio of the average thickness of the first enhanced thickness region to the average thickness of the first panel excluding the first enhanced thickness region is between 2:1 and 3:1. Additionally, in yet another embodiment, the average thickness of the first panel excluding the first enhanced thickness region of the first panel is between 0.7 mil and 0.95 mil and the average thickness of the first enhanced thickness region is 1.1 mil or greater. In yet another embodiment, the average thickness of the first panel excluding the first enhanced thickness region is between 0.7 mil and 1.2 mil and the average thickness of the first enhanced thickness region is 1.2 mil or greater.

In other embodiments of the present invention, the drawstring trash bag has a top edge of the second panel folded upon itself to form a second hem along an upper opening of the drawstring bag with a second hem seal defining a bottom of the second hem. The second hem seal extends from the first side edge to the second side edge of the drawstring bag. A second drawstring is disposed and secured within the second hem. Moreover, a second enhanced thickness region is defined in the second panel with the second enhanced thickness region extending from the first side edge to a second side edge and traversing the second hem seal. The average thickness of the second enhanced thickness region is greater than the average thickness of the second panel excluding the second enhanced thickness region, In some embodiments of the present invention, the second enhanced thickness region extends from the top edge of the second panel to below the second hem seal. In another embodiment, the second enhanced thickness region extends from the top edge of the second panel to at least one inch below the second hem seal. Moreover, in another embodiment, the second enhanced thickness region extends from the top edge of the second panel to between two inches and four inches below the second hem seal. Additionally, in yet another embodiment, the second enhanced thickness region extends from the upper opening of the drawstring bag to below the second hem seal. In yet another embodiment, the second enhanced thickness region extends from the upper opening of the drawstring bag to at least one inch below the second hem seal. Furthermore, in another embodiment of the present invention, the second enhanced thickness region extends from the upper opening of the drawstring bag to between two inches and four inches below the second hem seal.

In some embodiments of the present invention, a ratio of the average thickness of the second enhanced thickness region to the average thickness of the second panel excluding the second enhanced thickness region is between 1.1:1 and 4:1. Moreover, in some embodiments, a ratio of the average thickness of the second enhanced thickness region to the average thickness of the second panel excluding the second enhanced thickness region is between 2:1 and 3:1. Additionally, in yet another embodiment, the average thickness of the second panel excluding the second enhanced thickness region of the second panel is between 0.7 mil and 0.95 mil and the average thickness of the second enhanced thickness region is 1.1 mil or greater. In yet another embodiment, the average thickness of the second panel excluding the second enhanced thickness region is between 0.7 mil and 1.2 mil and the average thickness of the second enhanced thickness region is 1.2 mil or greater.

In accordance with another embodiment of the present invention, the first panel is divided into an upper portion and a lower portion. The average thickness of the upper portion of the first panel is greater than the average thickness of the lower portion of the first panel. In some embodiments, the upper portion of the first panel extends below the first hem seal. In another embodiment, the upper portion of the first panel extends at least one inch below the first hem seal. In yet another embodiment, the upper portion of the first panel extends between two inches and four inches below the first hem seal. Furthermore, in yet another embodiment, a ratio of the average thickness of the upper portion of the first panel to the average thickness of the lower portion of the first panel is between 1.1:1 and 4:1. Moreover, in another embodiment, a ratio of the average thickness of the upper portion of the first panel to the average thickness of the lower portion of the first panel is between 2:1 and 3:1. In yet another embodiment, the average thickness of the lower portion of the first panel is between 0.7 mil and 0.95 mil and the average thickness of the upper portion of the first panel is 1.1 mil or greater. Furthermore, in another embodiment, the average thickness of the lower portion of the first panel is between 0.7 mil and 1.2 mil and the average thickness of the upper portion of the first panel is 1.2 mil or greater.

BRIEF DESCRIPTION OF THE RELATED DRAWINGS

A more complete understanding of the present invention may be obtained by reference to the detailed description of the present invention when viewed in conjunction to the accompanying drawings. The drawings can be briefly described as follows.

FIG. 1 provides a perspective view of one embodiment of the present invention.

Figure 2:
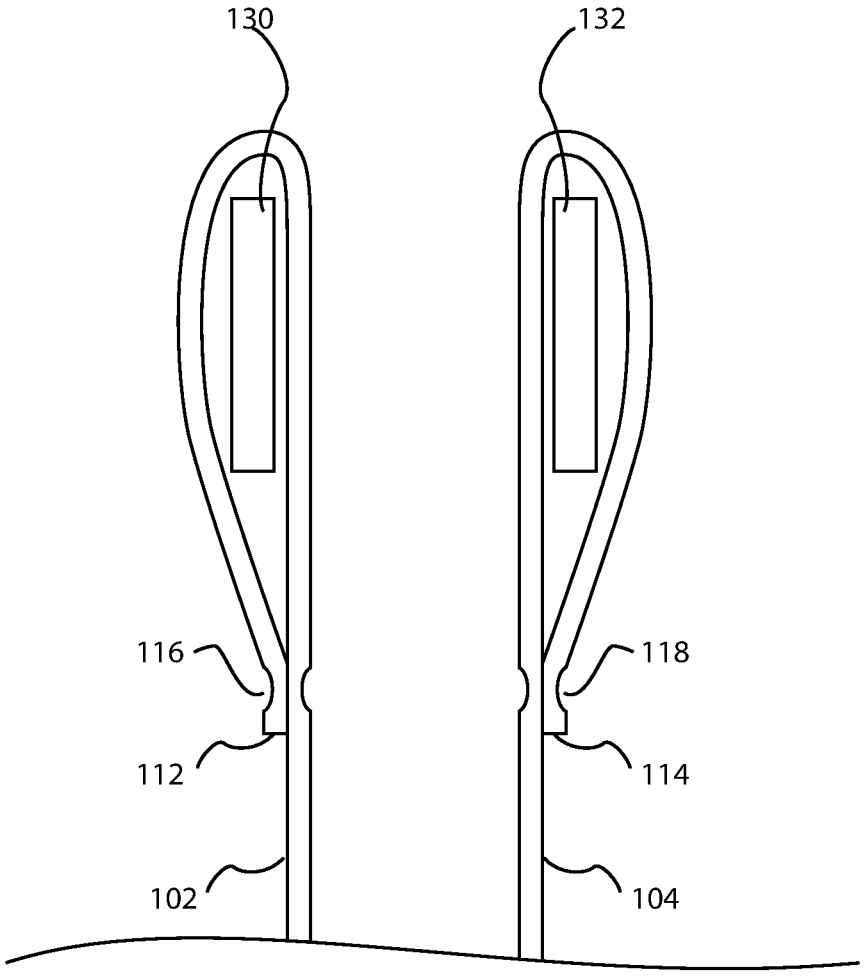

FIG. 2 provides an elevation view of a cross section of the top section of one embodiment of the present invention.

Figure 3:
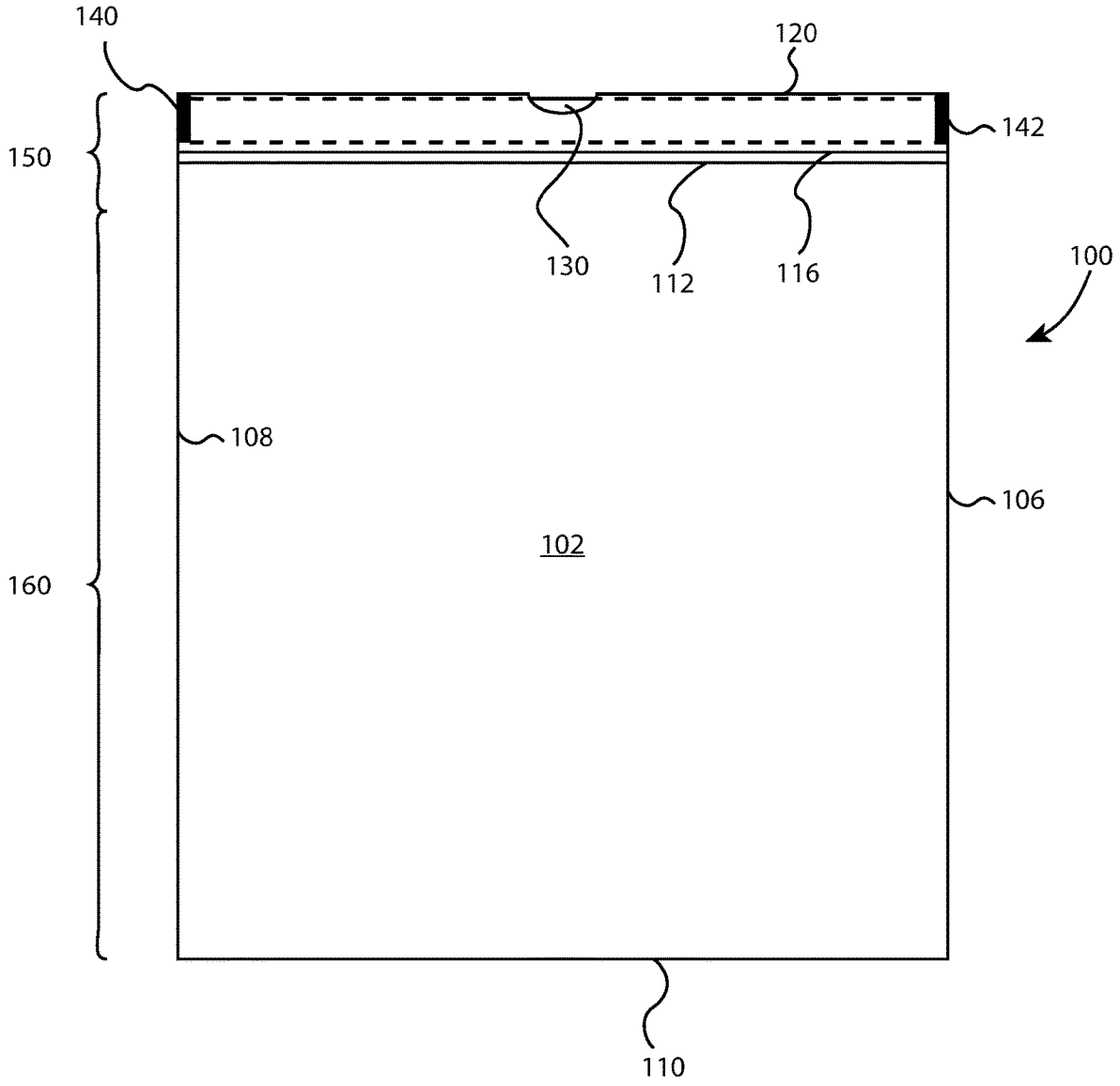

FIG. 3 provides a front elevation view of one embodiment of the present invention.

Figure 4:
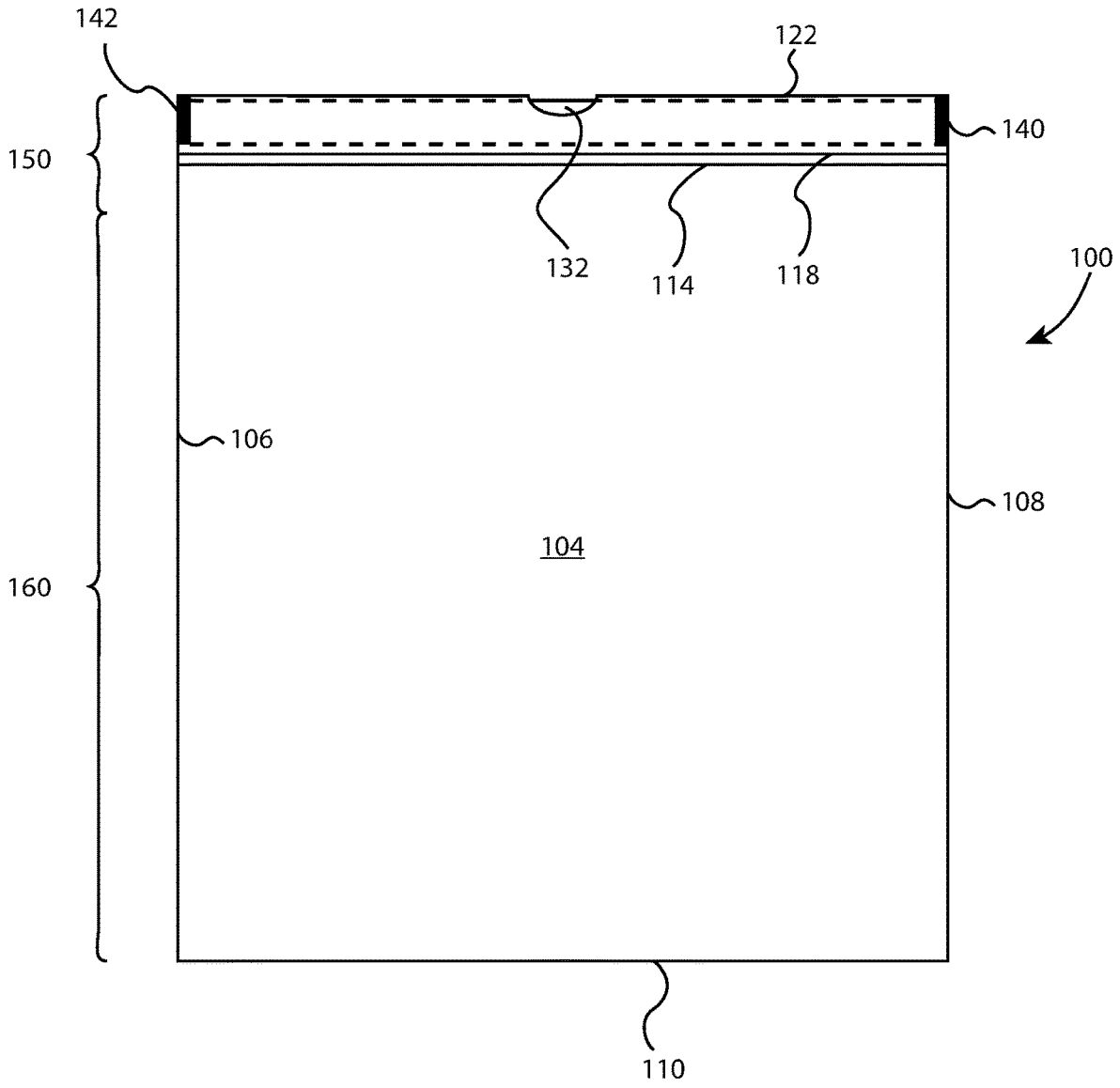

FIG. 4 provides a back elevation view of one embodiment of the present invention.

DETAILED DESCRIPTION OF THE INVENTION

The present disclosure illustrates one or more embodiments of the present invention. It is not intended to provide an illustration of or encompass every embodiment contemplated in connection with the present invention. In view of the disclosure of the present invention contained herein, a person having ordinary skill in the art will recognize that innumerable modifications and insubstantial changes may be incorporated or otherwise included within the present invention without diverging from the spirit of the invention. Therefore, it is understood that the present invention is not limited to those embodiments disclosed herein. The appended claims are intended to more fully and accurately encompass the invention to the fullest extent possible, but it is fully appreciated that the use of particular terms may not be intended to conclusively limit the scope of protection.

Referring initially to FIG. 1, a perspective view of drawstring trash bag 100 is shown according to one embodiment of the present invention. The drawstring trash bag 100 is formed from a first panel 102 and a second panel 104, the first panel 102 and second panel 104 are both rectangular in shape. To define the body of the bag, the first panel 102 and the second panel 104 are joined along a first side edge 106, a second side edge 108, and a bottom edge 110 of the respective first panel 102 and second panel 104.

In some embodiments, the first panel 102 and the second panel 104 may be formed from a single thermoplastic film folded to define a bottom edge 110 where the first panel 102 and the second panel 104 are joined. In such embodiments, the first panel 102 and second panel 104 may be joined by one or more seals extending along the first side edge 106 and the second side edge 108. In alternative embodiments, the first panel 102 and the second panel 104 may be formed from a single thermoplastic film folded to define a first edge 102 while the first panel 102 and second panel 104 may be joined by one or more seals extending along the second side edge 108 and the bottom edge 110. Finally, in other embodiments, the first panel 102 and the second panel 104 may be formed of separate thermoplastic films joined by one or more seals extending along the first side edge 106, the second side edge 108, and the bottom edge 110 or the first panel 102 and the second panel 104 may be a tubular thermoplastic film joined by flattening the tube to define the first side edge 106 and the second side edge 108 with a seal extending along the bottom edge 110.

In many embodiments, including the depicted embodiment, a distal end 112 of the first panel 102 is folded over to define the first hem 120 with a first hem seal 116 provided across the width of the drawstring trash bag 100. The first hem seal 116 also defines the bottom of the first hem 120. FIG. 2 depicts a cross-section view of the first hem 120 and the second hem 122. In this cross-section view, a distal end 114 of the second panel 104 is folded over to define the second hem 122 with a second hem seal 118 provided across the width of the drawstring trash bag 100. The second hem seal 118 also defines the bottom of the second hem 122.

A first drawstring 130 is disposed within the first hem 120, the first drawstring 130 extending across the width of the drawstring trash bag 100. Similarly, a second drawstring 132 is disposed within the second hem 122, the second drawstring 132 extending across the width of the drawstring trash bag 100. In some embodiments, the ends of the first drawstring 130 and the second drawstring 132 are anchored to the upper corners of the drawstring trash bag 100 by providing short seals 140 and 142 welding together the first panel 102, the second panel 104, the first drawstring 130, and the second drawstring 132. It is contemplated that the drawstrings of the present invention may be either non-extensible or extensible drawstrings as known in the art.

FIG. 3 and FIG. 4 provide additional views of the front and rear of the drawstring trash bag 100 illustrating that each of the first panel 102 and the second panel 104 of the drawstring trash bag 100 is divided into an upper portion 150 and a lower portion 160. In embodiments of the present invention, the upper portion 150 and the lower portion 160 of the drawstring trash bag 100 have different thicknesses. Specifically, the thickness of thermoplastic film in the upper portion 150 of the first panel 102 and the second panel 104 is greater than the thickness of the thermoplastic film in the lower portion of the first panel 102 and the second panel 104.

Variations in the manufacturing process results in some variability in the thickness of any thermoplastic film. However, the thickness a thermoplastic film is typically described in terms of the average thickness of the film across an area. In the case of the present invention, the average thickness of the thermoplastic film in the lower portions 160 of the drawstring trash bag 100 is less than the average thickness of the thermoplastic films in the upper portions 150 of the drawstring trash bag 100. A person having ordinary skill in the art would understand the methods of measuring and determining the thickness of such thermoplastic films and, further, would understand that in some embodiments of the present invention the localized thickness of the thermoplastic film at certain points in the upper portions 150 may actually be less than the localized thickness of the thermoplastic film at certain points in the lower portion 160 of the drawstring trash bag 100.

The thickness of the upper portion 150 and lower portion 160 of a panel 102 or 104 may be defined in terms of the ratio of the average thickness of the upper portion 150 to the average thickness of the lower portion 160 or in terms of specific average thicknesses, or range of thicknesses, for each of the respective portions 150 and 160. For example, in certain embodiments of the present invention, the ratio of the average thickness of the upper portion 150 of a panel 102 or 104 to the average thickness of the lower portion 160 of a panel 102 or 104 may be in the range of 1.1:1 and 4:1. Moreover, in some embodiments, the ratio of the average thickness of the upper portion 150 of a panel 102 or 104 to the average thickness of the lower portion 160 of a panel 102 or 104 may be in the range of 2:1 to 3:1. With regard to specific average thicknesses for certain embodiments, the average thickness of the lower portion 160 may be between 0.7 mil and 0.95 mil while the average thickness of the upper portion 150 may be greater than 1.1 mil. Additionally, in some embodiments the average thickness of the lower portion 160 may be between 0.7 mil and 1.2 mil while the average thickness of the upper portion 150 may be greater than 1.2 mil.

Alternatively, the first panel 102 and the second panel 104 can be described in terms of each respective panel 102 and 104 having an enhanced thickness region. In this case, like with the upper portion 150 and lower portion 160, the enhanced thickness region of a panel 102 or 104 may be defined in terms of the ratio of the average thickness of the enhanced thickness region of a panel 102 or 104 to the average thickness of the panel 102 or 104 excluding the enhanced thickness region. For example, in certain embodiments of the present invention, the ratio of the average thickness of the enhanced thickness region of a panel 102 or 104 to the average thickness of the panel 102 or 104 excluding the enhanced thickness region may be in the range of 1.1:1 and 4:1. Moreover, in some embodiments, the ratio the average thickness of the enhanced thickness region of a panel 102 or 104 to the average thickness of the panel 102 or 104 excluding the enhanced thickness region may be in the range of 2:1 to 3:1. With regard to specific average thicknesses for certain embodiments, the average thickness of a panel 102 or 104 excluding the enhanced thickness region may be between 0.7 mil and 0.95 mil while the average thickness of the enhanced thickness region of same panel 102 or 104 may be greater than 1.1 mil. Additionally, in some embodiments the average thickness of the panel 102 or 104 excluding the enhanced thickness region may be between 0.7 mil and 1.2 mil while the average thickness of the enhanced thickness region of same panel 102 or 104 may be greater than 1.2 mil.

In certain embodiments of the present invention, the upper portion 150 or enhanced thickness region of a panel 102 or 104 traverses the respective hem seal 116 or 118 and extends at least one inch below the bottom of the first hem seal 116 or second hem seal 118. Moreover, in some embodiments, the upper portion 150 or enhanced thickness region of a panel 102 or 104 traverses the respective hem seal 116 or 118 and extends between two inches and four inches below the bottom of the first hem seal 116 or second hem seal 118. Additionally, in some embodiments the upper portion 150 or enhanced thickness region of a panel 102 or 104 may extend to the upper opening 120 and 122 of the drawstring trash bag or, in other embodiments, all the way to the top edge 112 or 114 of the respective panel 102 or 104. Furthermore, in some embodiments the transition at the bottom of the upper portion 150 or enhanced thickness region of a panel 102 or 104 may be quick and abrupt while in other embodiments the transition may be a gradual decrease in film thickness from the upper portion 150 to the lower portion 160 of the drawstring trash bag 100.

In some embodiments, the use of increased air cooling during the extrusion process can be used to increase the thickness of the film in the upper portion 150 of the drawstring trash bag 100. Increased cooling can be provided by increasing the air flow along the surface of extruded film. In other embodiments, the thermoplastic film may be formed with a multi-layered die where additional thermoplastic material can be co-extruded in the upper region. Furthermore, the additional thermoplastic material may differ from the thermoplastic material used for the remainder of the thermoplastic film. Regardless, the present invention is not intended to be limited in scope with respect to the method of creating the thicker upper portions 150.

As previously noted, the specific embodiments depicted herein are not intended to limit the scope of the present invention. Indeed, it is contemplated that any number of different embodiments may be utilized without diverging from the spirit of the invention. Therefore, the appended claims are intended to more fully encompass the full scope of the present invention.

I claim:

1. A drawstring bag of thermoplastic film comprising:

a first panel and a second panel, the first panel and second panel joined along a first side edge, a second side edge, and a bottom edge, a top edge of the first panel folded upon itself to form a first hem along an upper opening of the drawstring bag with a first hem seal defining a bottom of the first hem, a first drawstring disposed and secured within the first hem, a first enhanced thickness region defined in the thermoplastic film of the first hem, the first enhanced thickness region extending from the upper opening of the drawstring bag to below the first hem seal, an average thickness of the first enhanced thickness region greater than an average thickness of the first panel excluding the first enhanced thickness region and less than an average thickness of the first drawstring, wherein each of the average thicknesses is measured through a single layer of the thermoplastic film, and the first panel excluding the first enhanced thickness region devoid of a ribbed pattern.

2. The drawstring bag of claim 1, further comprising:

the first enhanced thickness region extends from the upper opening of the drawstring bag to at least one inch below the first hem seal.

3. The drawstring bag of claim 2, further comprising:

the first enhanced thickness region extends from the upper opening of the drawstring bag to between two inches and four inches below the first hem seal.

4. The drawstring bag of claim 1, further comprising:

a top edge of the second panel folded upon itself to form a second hem along an upper opening of the drawstring bag with a second hem seal defining a bottom of the second hem, the second hem seal extending from the first side edge to the second side edge of the drawstring bag, a second drawstring disposed and secured within the second hem, a second enhanced thickness region defined in a thermoplastic film forming the second panel, the second enhanced thickness region extending from the first side edge to a second side edge and traversing the second hem seal, and wherein an average thickness of the second enhanced thickness region measured across the thermoplastic film forming the second panel is greater than an average thickness of the second panel excluding the second enhanced thickness region.

5. The drawstring bag of claim 4, further comprising:

the second enhanced thickness region extends from the upper opening of the drawstring bag to below the second hem seal.

6. The drawstring bag of claim 5, further comprising:

the second enhanced thickness region extends from the upper opening of the drawstring bag to at least one inch below the second hem seal.

7. The drawstring bag of claim 6, further comprising:

the second enhanced thickness region extends from the upper opening of the drawstring bag to between two inches and four inches below the second hem seal.

8. A drawstring bag of thermoplastic film comprising:

a first panel and a second panel, the first panel and second panel joined along a first side edge, a second side edge, and a bottom edge, a top edge of the first panel folded upon itself to form a first hem along an upper opening of the drawstring bag with a first hem seal defining a bottom of the first hem, a first drawstring disposed and secured within the first hem, the thermoplastic film of the first panel divided into an upper portion and a lower portion, the upper portion extending below the first hem seal, an average thickness of each layer of the upper portion greater than an average thickness of each layer of the lower portion and less than an average thickness of the first drawstring, wherein each of the average thicknesses is measured through the thermoplastic film from a first side to an opposing second side, and the lower portion of the thermoplastic film devoid of a ribbed pattern.

9. The drawstring bag of claim 8, further comprising:

the upper portion of the first panel extends at least one inch below the first hem seal.

10. The drawstring bag of claim 9, further comprising:

the upper portion of the first panel extends between two inches and four inches below the first hem seal.

11. The drawstring bag of claim 8, further comprising:

a top edge of the second panel folded upon itself to form a second hem along an upper opening of the drawstring bag with a second hem seal defining a bottom of the second hem, the second hem seal extending from the first side edge to the second side edge of the drawstring bag, a second drawstring disposed and secured within the second hem, a second enhanced thickness region defined in a thermoplastic film forming the second panel, the second enhanced thickness region extending from the first side edge to a second side edge and traversing the second hem seal, and wherein an average thickness of the second enhanced thickness region measured across the thermoplastic film forming the second panel is greater than an average thickness of the second panel excluding the second enhanced thickness region.

12. The drawstring bag of claim 11, further comprising:

the second enhanced thickness region extends from the upper opening of the drawstring bag to below the second hem seal.

13. The drawstring bag of claim 12, further comprising:

the second enhanced thickness region extends from the upper opening of the drawstring bag to at least one inch below the second hem seal.

14. The drawstring bag of claim 13, further comprising:

the second enhanced thickness region extends from the upper opening of the drawstring bag to between two inches and four inches below the second hem seal.

* * * * *